109-11 SR

9/28/82 XR 4,351,247

United States Patent [19]

Clark

[11] 4,351,247

[45] Sep. 28, 1982

[54] PASS-THROUGH FOR DRIVE-UP WINDOW

[76] Inventor: Larry G. Clark, 5532 Hollister Dr., Indianapolis, Ind. 46224

[21] Appl. No.: 178,780

[22] Filed: Aug. 18, 1980

[51] Int. Cl.[3] ..... E06B 7/32; E05G 7/00

[52] U.S. Cl. ..... 109/19; 109/11

[58] Field of Search ..... 109/19, 10, 11, 12, 109/4–8

[56] References Cited

U.S. PATENT DOCUMENTS

| | | | |
|---|---|---|---|
| 1,362,798 | 12/1920 | Hughes | 109/19 |
| 1,669,539 | 5/1928 | Smart | 109/19 |
| 1,804,776 | 5/1931 | James | 109/19 |
| 3,055,319 | 9/1962 | Asprion | 109/12 |
| 3,702,101 | 11/1972 | Moore | 109/19 |
| 4,069,773 | 1/1978 | Clark | 109/19 |
| 4,084,518 | 4/1978 | Carlson | 109/19 |
| 4,158,999 | 6/1979 | Sukolics | 109/19 |

*Primary Examiner*—Reinaldo P. Machado
*Attorney, Agent, or Firm*—Woodard, Weikart, Emhardt & Naughton

[57] ABSTRACT

A pass-through assembly includes a housing installable in a building wall structure as a finished complete unit. It has a sector-shaped shelf with upstanding transparent walls on the straight edges of the shelf and intersecting adjacent a vertical hinge. The walls cooperate with a part-cylindrical wall of the housing to provide doors on the assembly and preclude direct access from outside to the inside of the building wall. The housing and shelf are arranged for a normal closed position avoiding need for a sheltered location, but the unit is useful regardless of weather conditions.

8 Claims, 7 Drawing Figures

PASS-THROUGH FOR DRIVE-UP WINDOW

BACKGROUND OF THE INVENTION

1. Field of the Invention

This invention relates generally to apparatus facilitating through-the-wall transactions between an employee of a business establishment inside the wall, and a customer outside the wall, and more particularly to a device useful in an unsheltered exterior location but retaining the security, convenience, and communications features heretofore found desirable in pass-through devices.

2. Description of the Prior Art

The most pertinent prior art known to me is the apparatus disclosed in my U.S. Pat. No. 4,069,773 issued Jan. 24, 1978, and described in a sheet of literature entitled "Transaction Security Equipment" distributed by Creative Industries, Inc. of 959 North Holmes, Indianapolis, Ind. 46222. In addition to the combination pass-through and deal tray shown in that patent and the literature, there is also shown in the literature on the back side, a "Lazy Susan Pass Thru." While the device shown in my above-mentioned patent utilizes a horizontal axis for pivoting of the deal tray or plate 26, the "Lazy Susan" device uses a vertical axis.

The device shown in my aforementioned patent is preferably employed in a sheltered location, typically indoors. If utilized in an outdoors/indoors location, without shelter, there would be exposure to rain and snow and resulting water accumulation in the unit, which would not be acceptable.

The "Lazy Susan" version, with some modification, could conceivably be employed in an outdoor/indoor location, but the nature of the construction is such that the rotatable support shelf is entirely within the boundaries of the fixed housing. In contrast, the drive-up pass-through of the present invention has a pivoting shelf which extends outward towards the customer (beyond the frontal surface of the housing of the pass-through). Therefore, the new drive-up pass-through would make for more convenience for the customer in being able to more easily reach items on the shelf, when it is rotated outward.

SUMMARY OF THE INVENTION

Described briefly, in a typical embodiment of the present invention, a housing may be incorporated in an exterior building wall, with associated glazing around it, as desired. Vertical axis hinge means are mounted on the housing and support a shelf unit for swinging in a horizontal plane for a rear position where the shelf is open to the employee's side of the wall, through an intermediate position where it is normally disposed when not in use, to an open position where the shelf is accessible to the customer at the exterior of the wall. Upstanding walls are provided at two sides of the shelf and cooperate with an arcuate wall in the housing within the rotational limits imposed on the shelf, to preclude direct access from outside the wall to the inside of the wall for any attainable rotational position of the shelf.

DESCRIPTION OF THE PREFERRED EMBODIMENT

Figure 1:
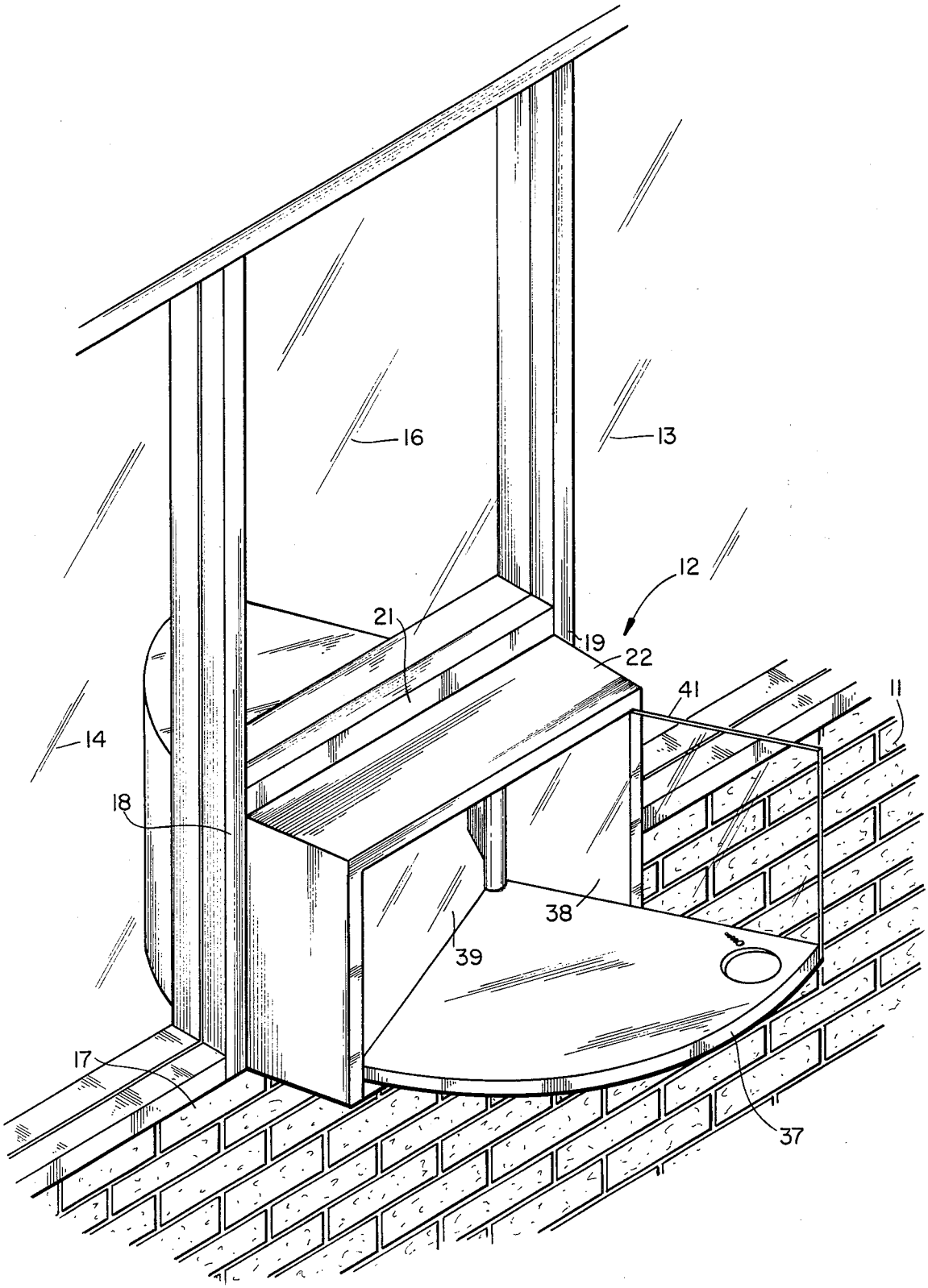
FIG. 1 is a fragmentary perspective view of a building wall with the pass-through incorporated in it according to a typical embodiment of the present invention.

Referring now to the drawings in detail, a brick veneer building wall is shown at 11, with the pass-through shown generally at 12, and glazing at 13 and 14 in the wall on opposite sides of the unit, and further glazing at 16 above the unit. The glazing may be of glass or plastic of the type, thickness, and strength needed depending upon the particular environment and degree of security desired. The assembly 12 is thus framed by the top course 17 of bricks, window frame members 18 and 19 at opposite sides of the unit, and window frame member 21 at the top of the unit. The housing 22 of the unit may be made of any of a variety of materials, formed and welded steel being one example, although other metals and possibly also plastics of suitable strength and durability, might also be used. At present, foam filled polyethylene shell construction seems preferable.

Figure 2:
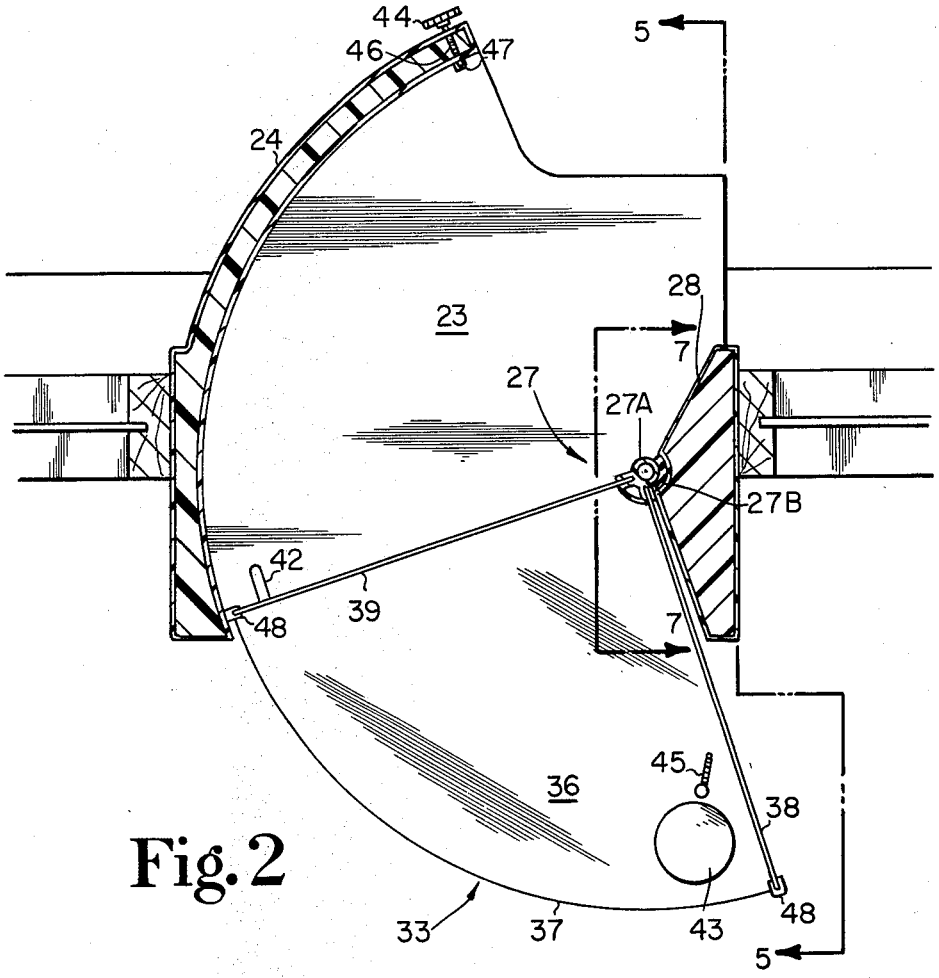
FIG. 2 is a schematic top plan view of the assembly with the shelf in open position.
Figure 3:
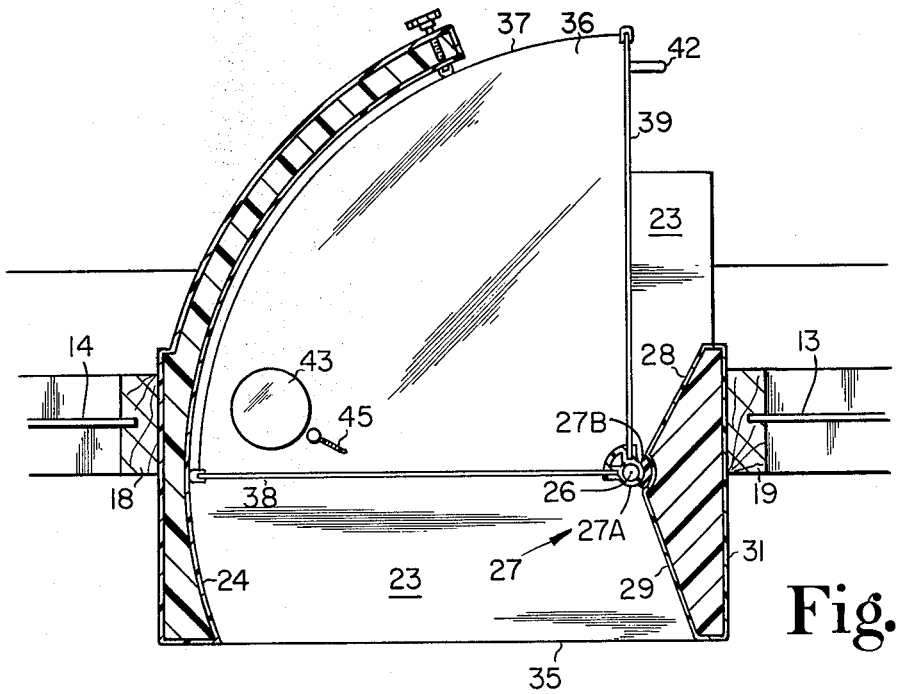
FIG. 3 is a schematic top plan view of the assembly with the shelf in locked position.
Figure 6:
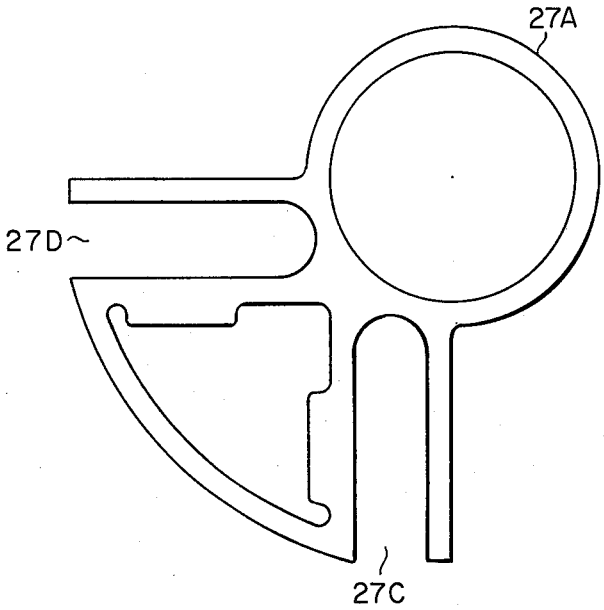
FIG. 6 is an enlarged end view of a hinge bracket extrusion employed in the typical embodiment of the present invention.
Figure 7:
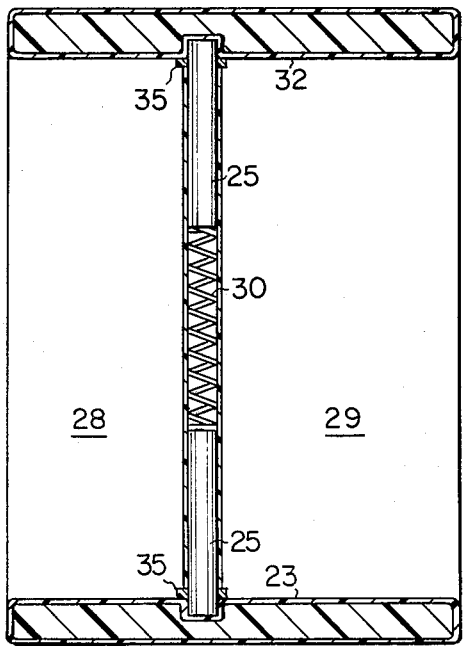
FIG. 7 is a section through the hinge assembly and housing taken at line 7—7 in FIG. 2 and viewed in the direction of the arrows.

The housing includes a horizontal bottom wall, the top surface of which forms a stationary floor 23 of a shape which can be best perceived by comparison of FIGS. 2 and 3. An upstanding part-cylindrical wall 24 is provided at the left-hand side of the floor 23 and it subtends an arc of 90° about a vertical axis 26. Axis 26 is colinear with the axis of a hinge assembly 27 which includes a hinge bracket extrusion 27A of special cross section as best shown in FIG. 6, and a pair of spring loaded hinge pins 25 as best shown in FIG. 7. The pins 25 are urged by spring 30 into sockets formed in the housing floor 23 and ceiling 32. Nylon bushings 35 serve as thrust bearings at the upper and lower ends of the hinge bracket 27 so the hinge bracket can pivot freely about axis 26. A weather strip 27B is mounted to the right-hand wall 28, 29, 31 of the housing and seals against the extrusion, but permits the extrusion to turn freely while being sealed. This wall, 28, 29, 31 extends from the floor 23 to the ceiling 32 of the housing (FIGS. 4 and 7) as does the part-cylindrical wall 24.

The shelf assembly includes the sector-shaped bottom wall 36 having a part-cylindrical arcuate outer edge 37, centered about the axis 26. It also has upstanding walls 38 and 39 affixed to the base 36 and extending along the straight edges thereof and up to the upper edges 41 which are immediately adjacent and below the lower face 32 (ceiling) of the top wall of the housing. The lower edges of the shelf assembly walls are flush with the lower edge of the shelf 36 and immediately above the upper face 23 (floor) of the housing base. The arc subtended by edge 37 between walls 38 and 39 must be equal to or less than that subtended by the part-cylindrical housing wall 24. Hinge bracket 27A of the hinge assembly has longitudinally extending slots 27C and 27D snugly receiving walls 38 and 39, respectively. The walls can be fastened to it by screws or other suitable fasteners or adhesive. Also, a pull handle of a conventional U-shaped stirrup type 42 is provided on the inside face of the shelf wall 39. A cavity 43 is provided in the upper surface of the shelf 36 to conveniently receive and retain coins such as for currency change. A spring clip 45 is provided to secure currency bills to the shelf. It may typically be a tight coiled spring with one end secured to the shelf, and a ball on the other end to receive bills under it and clamp them to the shelf top under the urging of the spring.

A locking knob 44 (FIGS. 1, 3) is on shaft 46 threadedly received in the housing wall 24 and having a rubber tipped inner end 47 engageable with arcuate edge 37 of the shelf to lock the shelf in the position shown in FIG. 3 or any other position where the shelf edge is engageable by the lock tip 47.

Rotational limits of pivoting of the shelf are established by abutting engagement of wall 39 with wall 28 at one extreme, and wall 38 with wall 29 at the other extreme. The housing thus serves as a passageway which is always closed by one or the other of walls 38 and 39 which function in the passageway or opening, as doors in a doorway.

It is preferable that the two walls 38 and 39 of the shelf assembly be transparent, whereby they can serve as windows which may be particularly helpful to the driver of a vehicle whose window is approximately level with the window in the pass-through, but whose view through the window 16 in the wall, might be obscured. Also, it makes it possible for this pass-through to be used in an otherwise windowless wall. In addition, the provision of the transparent wall 39 enables the employee of the establishment to see what is placed on the shelf 36 by the customer, before the employee pulls the shelf from the open position to the rear position for access.

Figure 4:
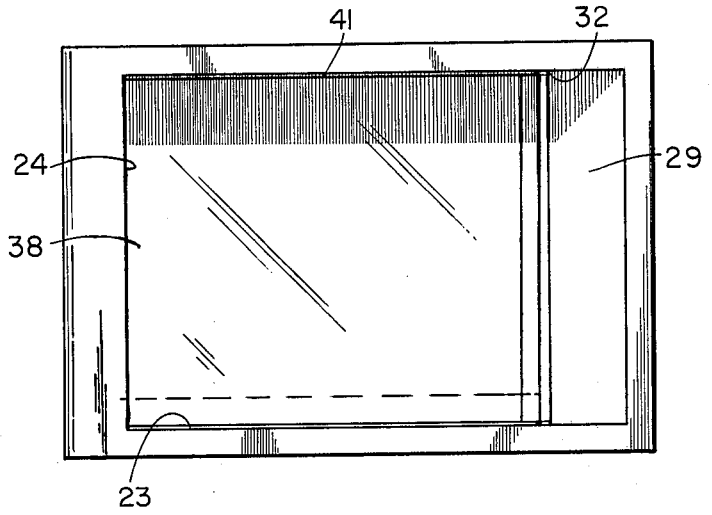
FIG. 4 is a front view of the assembly with the shelf in locked position.
Figure 5:
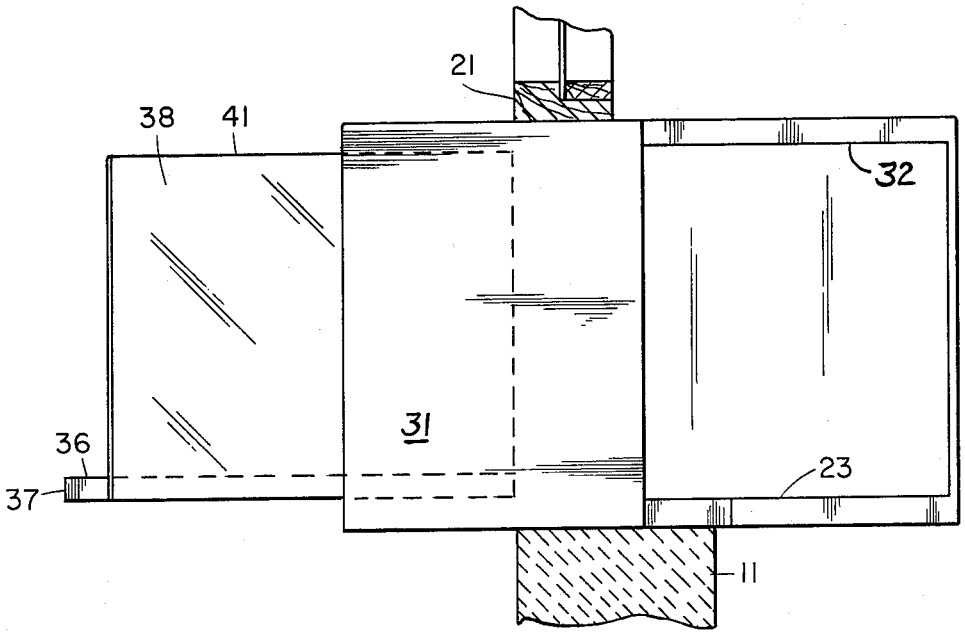
FIG. 5 is a section taken through the wall at line 5—5 in FIG. 2 and viewed in the direction of the arrows, and showing the side view of the pass-through with the shelf in open position.

The shelf position shown in FIGS. 3 and 4, which is the locked position of the assembly, places the wall 38 as well as the hinge axis essentially co-planar with the exterior wall surface of the building. Weather strip such as at 48 along the sides and bottom of the shelf and walls minimizes opportunity for entry of wind, much less rain or snow, into the building when the assembly is in any rotational position. In addition, where the unit is used in an unsheltered location, the wall 37 serving as a door can, when opened to the position shown in FIGS. 1 and 2, clear from the shelf or ledge 23 any accumulation of snow which might have occurred during a period when the establishment has been closed.

The assembly can be secured in the wall of the building by any suitable fastening means and, in view of the provision of the hinge structure on the right, the part-cylindrical wall on the left, and the top and bottom walls of the housing, there is ample opportunity to secure the assembly to the building structure at both sides, top and bottom, with conventional fasteners.

Since the walls 38 and 39 of the unit actually serve as doors, and are intended to be able to serve to protect the employee of the establishment, they can be made of a material of sufficient thickness and strength to withstand impact of bullets or other projectiles to the degree deemed necessary for the particular type of establishment and level of security desired. They may be made of glass, or plastics, or suitable combinations thereof. The fact that the base 36 is mounted inside of the two walls, with the walls extending down to the bottom edge of the base 36, enables the base to serve as a structural fillet or web between the walls, to provide a suitably sturdy unit without the necessity of having also a top fillet, web or gusset. In this way, the unit can be useful to the occupant of a vehicle which is much higher than the conventional automobile. Such person can reach down and place items on and remove items from the shelf 36 without the interference that a top fillet or web would cause. In addition, with the provision of a window 16 above the assembly, such customer could, nevertheless, maintain visual contact with the employee working at the window.

By way of example, but not limitation, the overall height of the housing may be 16 inches, and the radius of the shelf 36 may be about 18 inches. The front edge 35 of shelf 23 and the vertical and horizontal front edges of the walls 24, 29–31, and 32 which cooperate with shelf edge 35 to form the front doorway entrance of the housing, project out from the outside face of the wall about 7 inches.

From the foregoing description, it should be recognized that the present invention is useful not only for fast food restaurants which are likely to be the primary end users of this pass-through, but also for other types of business establishments where a drive-up window facility is desirable. A few examples would include financial institutions, gasoline filling stations, beverage and grocery stores.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In this regard where the terms employee and customer are used in the claims, they are used for convenience to reference typical circumstances, but not intended to limit coverage only to those installations where the person on one side is strictly speaking, a customer, and on the other, an employee.

What is claimed is:

1. In a building wall, a through-the-wall transfer apparatus for transactions between a business employee on one side of the wall and a customer on the other side of the wall, the apparatus comprising:

a housing mounted in the building wall;

a shelf for swinging in a horizontal plane from a rear position where it is open to the employee's side of the building wall, through an intermediate position where it is normally disposed when not in use, to an open position where it is accessible to the customer at the customer's side of the building wall;

upstanding walls at two sides of the shelf to preclude direct access from the customer's side of the building wall to the employee's side of the building wall for any position of the shelf;

hinge means mounted in said housing and having a vertical pivot axis, said shelf being mounted to said hinge means;

a part-cylindrical wall in said housing and having its cylindrical axis colinear with said pivot axis, said part-cylindrical wall extending from the space outside the customer's side of the building wall to the space inside the employee's side of the building wall;

hinge pin receiver means in said housing and receiving said hinge means thereon;

stop wall means in said housing adjacent said hinge means;

one of said upstanding walls being abuttingly engageable with said stop wall means when said shelf is swung inwardly through said rear position, to stop rotation of said shelf with the two upstanding walls facing the said inside space, and the other of said upstanding walls thereupon cooperating with said part-cylindrical wall and the top of the housing and said shelf to preclude customer access through said transfer apparatus from the customer side to employee side of the building wall.

2. The apparatus of claim 1 wherein:

said other of said upstanding walls is abuttingly engageable with said stop wall means when said shelf is swung outward through said open position to stop rotation of said shelf with the two upstanding walls facing the said outside space, and said one upstanding wall thereupon cooperating with said part-cylindrical wall and the top of said housing and said shelf to preclude customer access through said transfer apparatus from the customer side to employee side of the building wall.

3. The apparatus of claim 2 wherein:

at least portions of said upstanding walls are transparent.

4. In a building wall, a through-the-wall transfer apparatus for transactions between a business employee on one side of the wall and a customer on the other side of the wall, the apparatus comprising:

a housing mounted in the building wall;

a shelf for swinging in a horizontal plane from a rear position where it is open to the employee's side of the building wall, through an intermediate position where it is normally disposed when not in use, to an open position where it is accessible to the customer at the customer's side of the building wall;

upstanding walls at two sides of the shelf to preclude direct access from the customer's side of the building wall to the employee's side of the building wall for any position of the shelf;

said building wall having an outside face below said housing;

said shelf having a pivot axis which is substantially co-planar with the said outside face;

one of said upstanding walls being substantially coplanar with said outside face when said shelf is in said intermediate position;

said housing having a doorway entrance portion projecting into the space on the customer's side of the building wall;

said shelf being sector-shaped having two intersecting straight edges and an arcuate edge;

said upstanding walls lying along the straight edges of the shelf and intersecting substantially at said pivot axis; and said housing including a part-cylindrical wall extending from said doorway entrance portion into the space inside the employee's side of said building wall, and closely spaced from the arcuate edge of said shelf, and having a cylindrical axis colinear with said pivot axis.

5. A pass-through assembly for through-the-wall transfer of articles, said assembly comprising:

an integral housing having top, bottom, left and right-hand side walls forming an opening through the housing permitting horizontal passage of items through said opening from the rear of the housing to the front of the housing;

shelf means pivotally mounted in the housing for swinging about a vertical pivot axis;

upstanding wall means on said shelf means and cooperating with said housing side walls to obstruct the opening regardless of the position of said shelf means about its pivot axis, and thus serve as doors in the opening, with the opening serving as a doorway;

one of said side walls of said housing being a part-cylindrical upstanding wall and the other of said side walls of said housing being adjacent said pivot axis, said shelf means being hinged to the housing, with the pivotal axis being colinear with the hinge axis; and said shelf means being sector-shaped, having two straight edges and an arcuate edge, and said upstanding wall means affixed to said shelf means extending along two of the straight edges of said shelf means and intersecting along a vertical line adjacent said hinge axis.

6. The assembly of claim 5 and further comprising:

a cavity in the top of said shelf means to receive and retain small articles therein.

7. A pass-through assembly for through-the-wall transfer of articles, said assembly comprising:

an integral housing having top, bottom, left and right-hand side walls forming an opening through the housing permitting horizontal passage of items through said opening from the rear of the housing to the front of the housing;

shelf means pivotally mounted in the housing for swinging about a vertical pivot axis;

upstanding wall means on said shelf means and cooperating with said housing side walls to obstruct the opening regardless of the position of said shelf means about its pivot axis, and thus serve as doors in the opening, with the opening serving as a doorway;

at least part of said wall means affixed to said shelf means being transparent;

the top, bottom, left and right side walls of said housing providing a doorway entrance in a front edge of said housing;

said shelf means having one of said upstanding wall means thereof located in a plane parallel to a plane containing the front edge of said housing and spaced therefrom for an intermediate closed position;

said shelf means being sector-shaped, having two straight edges and an arcuate edge and having said upstanding wall means along two straight edges of the sector;

said wall means cooperating with said top, bottom, left and right side walls of said housing to close said doorway and thereby prevent passage of items through said opening without swinging said shelf means about its pivot axis;

one of said side walls of said housing being part-cylindrical and subtending an arc of 90°; and said wall means and the arcuate edge of said shelf means subtending an angle no greater than the angle subtended by the part-cylindrical wall, with shelf stop means to limit pivoting of said shelf means to thereby keep the doorway closed at all times regardless of whether or not said doorway entrance is open.

8. The assembly of claim 7 and further comprising:

a locking device including a shaft threadedly received in said housing and having a knob at an outer end and a friction pad at an inner end, said pad being engageable with said arcuate edge at various angular positions of said shelf means upon threadedly advancing said shaft to lock said shelf means in said positions.

* * * * *